US008008996B2

(12) United States Patent
Chen et al.

(10) Patent No.: US 8,008,996 B2
(45) Date of Patent: Aug. 30, 2011

(54) LOW-PASS FILTER

(75) Inventors: Hsin-Ping Chen, Taipei Hsien (TW); Kuang-Wei Cheng, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 431 days.

(21) Appl. No.: 12/193,776

(22) Filed: Aug. 19, 2008

(65) Prior Publication Data

US 2009/0231063 A1 Sep. 17, 2009

(30) Foreign Application Priority Data

Mar. 14, 2008 (CN) ..... 2008 1 0300575

(51) Int. Cl.
*H01P 1/203* (2006.01)

(52) U.S. Cl. ..... 333/204

(58) Field of Classification Search ..... 333/219, 333/202–205

See application file for complete search history.

(56) References Cited

U.S. PATENT DOCUMENTS

2007/0103260 A1* 5/2007 Shih ..... 333/202
2007/0236311 A1* 10/2007 Chen ..... 333/204
2009/0237183 A1* 9/2009 Chen et al. ..... 333/204

FOREIGN PATENT DOCUMENTS

TW 200740021 10/2007
TW 200807796 2/2008

* cited by examiner

*Primary Examiner* — Benny Lee
*Assistant Examiner* — Gerald Stevens
(74) *Attorney, Agent, or Firm* — Frank R. Niranjan

(57) ABSTRACT

A low-pass filter (10) includes an input portion (100) inputting an electromagnetic signal, an output portion (120) outputting the electromagnetic signal, a high impedance transmission portion (140) electrically connected to the input portion and the output portion to transmit the electromagnetic signal therebetween, a first low impedance transmission portion (160) electrically connected to the input portion and an end of the high impedance transmission portion, and a second low impedance transmission portion (180) electrically connected to the output portion and another end of the high impedance transmission portion. The two low impedance transmission portions are arranged beside the high impedance transmission portion, and each of the low impedance transmission portions is triangular.

8 Claims, 5 Drawing Sheets

LOW-PASS FILTER

BACKGROUND

1. Field of the Invention

The present invention generally relates to signal filtering, and more particularly to a low-pass filter.

2. Description of Related Art

Conventionally, when a wireless network product is working at high power, harmonic components of high frequencies are generated by the nonlinear properties of the active components, causing electromagnetic interference (EMI).

To solve this problem, the manufacturers of such wireless network products often use a filter to suppress the noise generated by the harmonic components. Features of an ideal filter are zero signal attenuation within a pass band, becoming infinite within a stop band, and transition as sharp as possible from the pass band to the stop band, providing the shortest possible distance between a transmission zero point and the stop band. In addition, increased transmission zero points improve performance of the filter in suppression of harmonic noise.

Referring to FIG. 4, a conventional low-pass filter 40 is shown. The low-pass filter 40 includes an input portion 400, an output portion 420 aligned with the input portion 400, a high impedance transmission portion 440 electrically connected to the input 400 and the output 420, a rectangular first low impedance transmission portion 460 electrically connected to the high impedance transmission portion 440, and a rectangular second low impedance transmission portion 480 parallel to the first low impedance transmission portion 460 and electrically connected to the high impedance transmission portion 440. The input portion 400 inputs the electromagnetic signal. The output portion 420 outputs the electromagnetic signal. The input portion 400 and the output portion 1420 have impedance values of approximately 50 ohms (Ω), respectively. The first low impedance transmission portion 460 and the second low impedance transmission portion 480 have the same length and width. An overall length of the low-pass filter 40 is 8.69 millimeters (mm), and an overall width of the low-pass filter 40 is 3.53 mm. An area of the low-pass filter 40 is 30.67 $mm^2$.

FIG. 5 is a diagram showing a relationship between amplitude of insertion or return loss and frequency of an electromagnetic signal traveling through the low-pass filter 40. As shown in FIG. 5, only one transmission zero point is generated, such that the low-pass filter 40 is not effective in the suppression of harmonic noise.

Therefore, a heretofore unaddressed need exists in the industry to overcome the described limitations.

SUMMARY

In an exemplary embodiment, a low-pass filter includes an input portion for input of an electromagnetic signal, an output portion for output of the electromagnetic signal, a high impedance transmission portion electrically connected to the input portion and the output portion to transmit the electromagnetic signal therebetween, a first low impedance transmission portion electrically connected to the input portion and an end of the high impedance transmission portion, and a second low impedance transmission portion electrically connected to the output portion and another end of the high impedance transmission portion. The two low impedance transmission portions are arranged beside the high impedance transmission portion, and each of the low impedance transmission portions is triangular.

Other objectives, advantages and novel features of the present invention will be drawn from the following detailed description of preferred embodiments of the present invention with the attached drawings, in which:

DETAILED DESCRIPTION OF THE EMBODIMENTS

Figure 1:
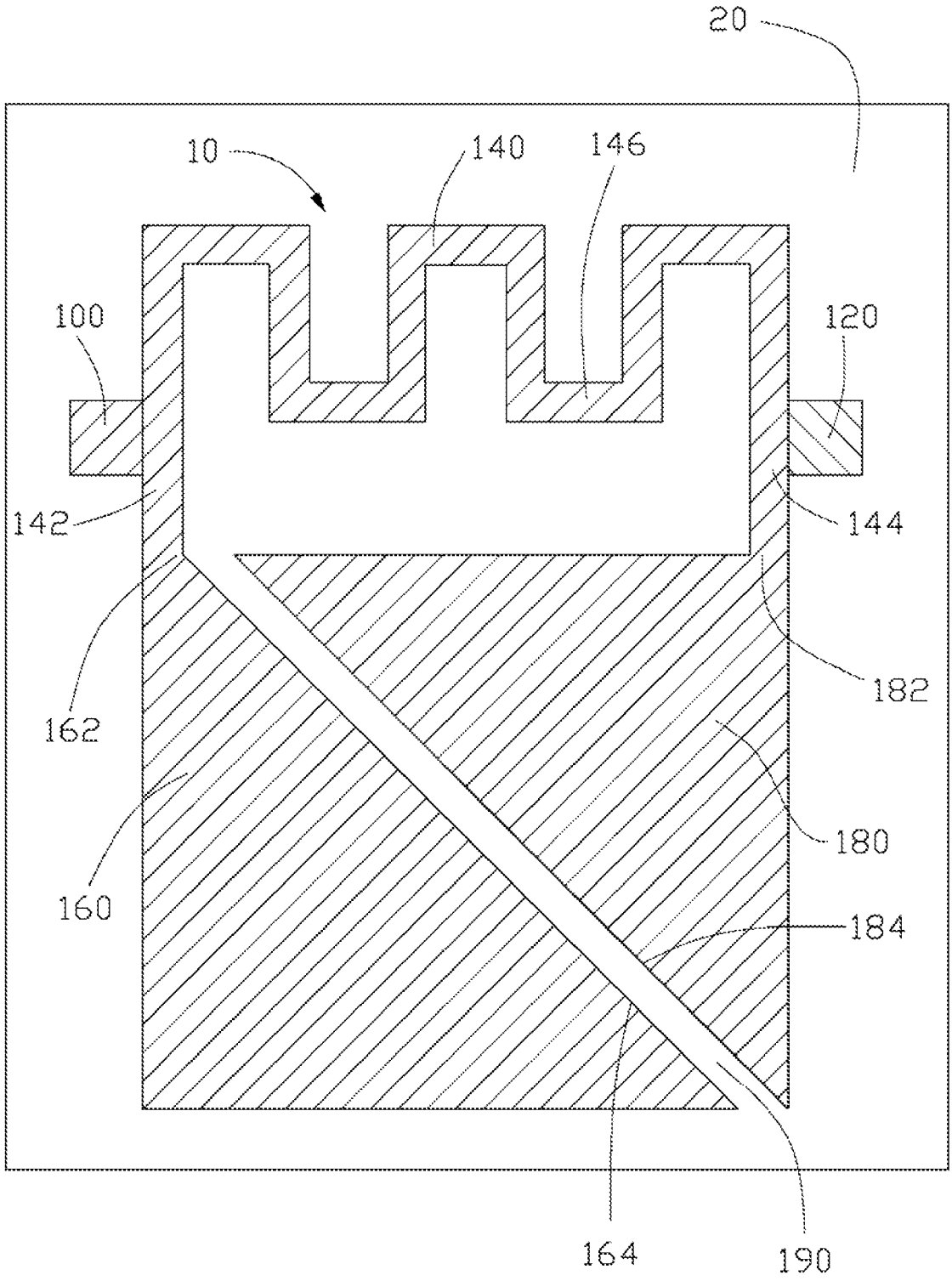
FIG. 1 is a schematic diagram of a low-pass filter of an exemplary embodiment of the invention.

FIG. 1 is a schematic diagram of a low-pass filter 10 of an exemplary embodiment of the present invention. The low-pass filter 10 is printed on a printed circuit board (PCB) 20, and is a microstrip filter.

The low-pass filter 10 includes an input portion 100, an output portion 120 aligned with the input portion 100, a high impedance transmission portion 140, a first rectangular low impedance transmission portion 160, and a second rectangular low impedance transmission portion 180.

The input portion 100 inputs electromagnetic signals. The output portion 120 outputs the electromagnetic signals. The input portion 100 and the output portion 120 have impedance values of approximately 50Ω, respectively.

The high impedance transmission portion 140 has a varied shape. The high impedance transmission portion 140 comprises a first connecting portion 142 electrically connected to the input portion 100, a second connecting portion 144 electrically connected to the output portion 120, and a bent portion 146 located between the first connecting portion 142 and the second connecting portion 144 and electrically connecting the first connecting portion 142 to the second connecting portion 144. That is, the high impedance transmission portion 140 extends varyingly from the input portion 100 to the output portion 120.

In the exemplary embodiment, the bent portion 146 is concertinaed. This configuration is also known as a comb-line structure. In the illustrated embodiment, the bent portion 146 is angular, or sharp-cornered. In another exemplary embodiment, the bent portion 146 may be curved, with rounded corners or portions. In still another exemplary embodiment, the bent portion 146 may be both angular and curved, that is, the bent portion 146 may have a combination of angular corners or portions and curved corners or portions.

In the exemplary embodiment, the bent portion 146 reduces an area of the low-pass filter 10. The high impedance transmission portion 140 and the first low impedance transmission portion 160 are respectively located two sides of the second low impedance transmission portion 180. That is to say, the second low impedance transmission portion 180 is disposed between the high impedance transmission portion 140 and the first low impedance transmission portion 160. The second low impedance transmission portion 180 and the high impedance transmission portion 140 cooperatively define an E-shaped space therebetween.

The first and second low impedance transmission portions 160 and 180 are each right triangular, with a hypotenuse 164 of the first low impedance transmission portion 160 coupled to a hypotenuse 184 of the second low impedance transmission portion 180. The first low impedance transmission portion 160 comprises a third connecting portion 162 in an end portion of the hypotenuse 164 thereof. Another end portion of the hypotenuse 164 is free. The third connecting portion 162 is electrically connected to the input portion 100 and the first connecting portion 142 of the high impedance transmission portion 140. The second low impedance transmission portion 180 comprises a fourth connecting portion 182 electrically connected to the output portion 120 and the second connecting portion 144 of the high impedance transmission portion 140. The fourth connecting portion 182 is in a vertically angled portion of the right triangle of the second low impedance transmission portion 180.

A slot 190 is formed between the first low impedance transmission portion 160 and the second low impedance transmission portion 180.

In this embodiment, an overall length of the low-pass filter 10 is 5.13 mm, and an overall width of the low-pass filter 10 3.78 mm. An area of the low-pass filter 10 is 19.39 $mm^2$. Compared to the conventional low-pass filter 40, the area of the low-pass filter 10 is reduced by 36.8%.

Figure 2:
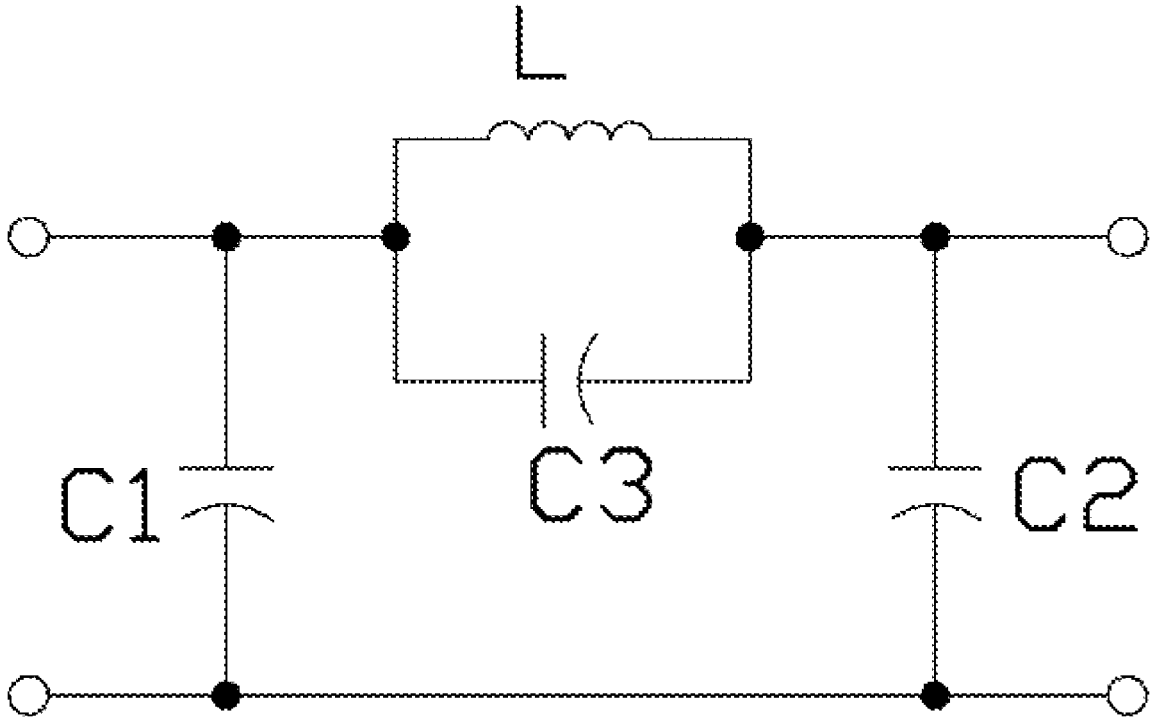
FIG. 2 is a schematic view of an equivalent circuit of the low-pass filter of FIG. 1.

FIG. 2 is a schematic diagram of an equivalent circuit of the low-pass filter 10. In FIG. 2, the high impedance transmission portion 140 is equivalent to an inductor L. A capacitor C1 is formed between the first low-impedance transmission portion 160 and ground of the PCB 20. A capacitor C2 is formed between the second low-impedance transmission portion 180 and ground of the PCB 20. A coupling capacitor C3 is formed between the second low-impedance transmission portion 180 and the first low-impedance transmission portion 160.

Figure 3:
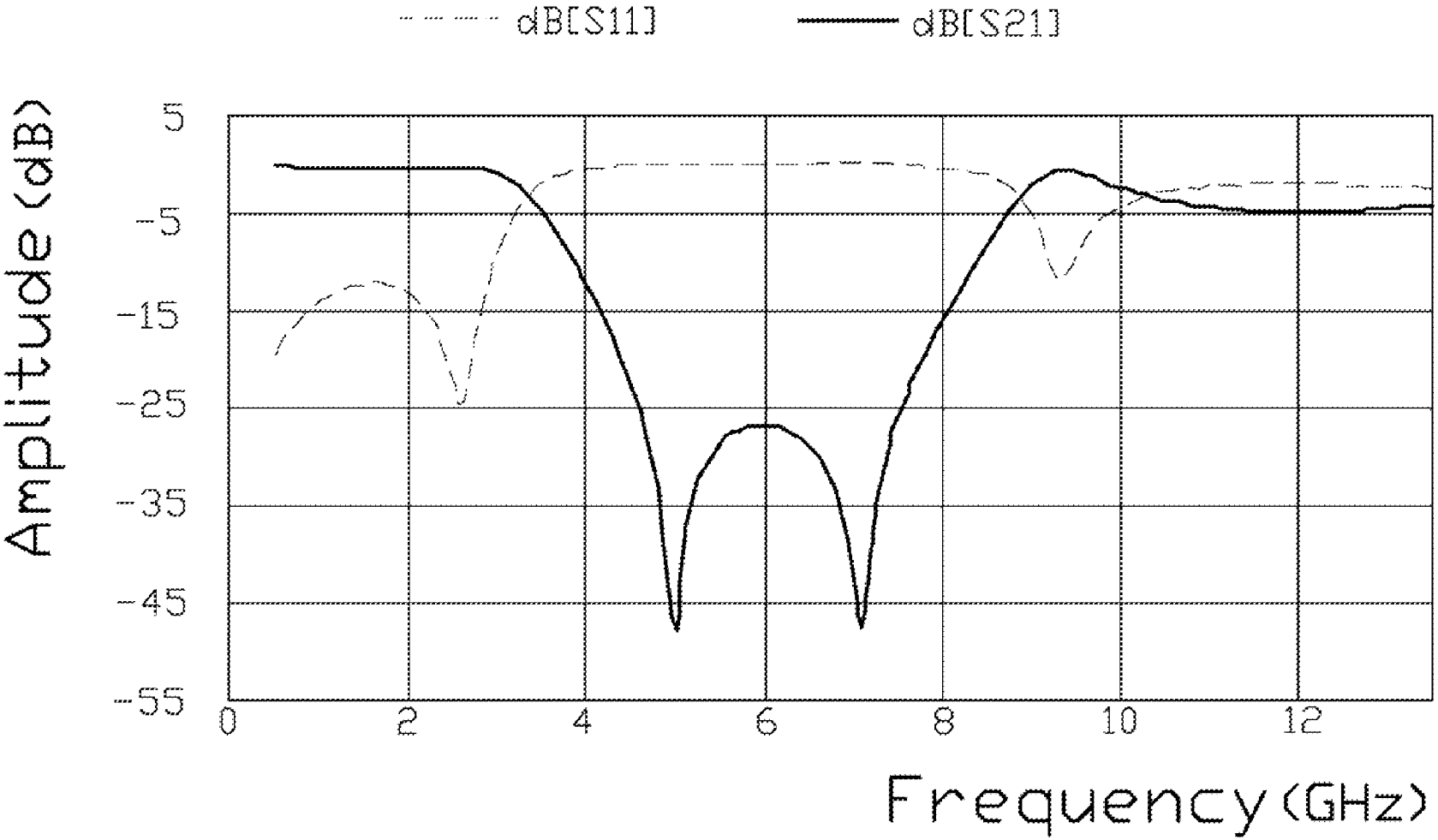
FIG. 3 is a diagram showing a relationship between amplitude of insertion or return loss and frequency of electromagnetic signals through the low-pass filter of FIG. 1.
Figure 4:
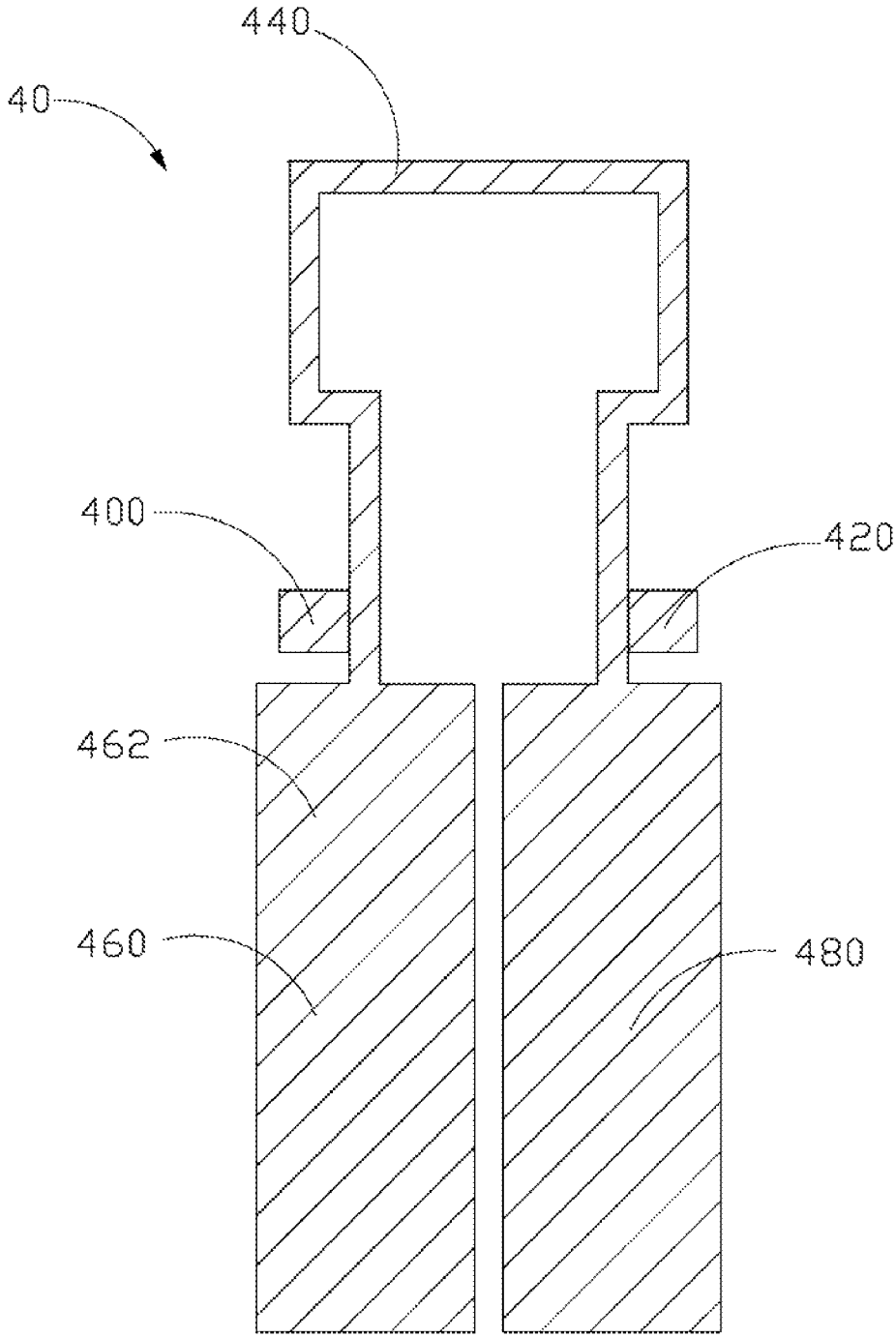
FIG. 4 (RELATED ART)
FIG. 4 is a schematic diagram of a conventional low-pass filter.

FIG. 3 is a diagram showing a relationship between amplitude of insertion or return loss and frequency of an electromagnetic signal traveling through the low-pass filter 10. The horizontal axis represents the frequency in gigahertz (GHz) of the electromagnetic signal traveling through the low-pass filter 10, and the vertical axis represents the amplitude of insertion or return loss in decibels (dB) of the low-pass filter 10.

In FIG. 3, the insertion loss is represented by a solid line S21, and the return loss is represented by a broken line S11. The curve S21 represents the insertion loss indicating a relationship between input power and output power of the electromagnetic signals traveling through the low-pass filter 10, and the insertion loss is represented by the formula:

$$\text{Insertion Loss}=-10*\text{Log}\,[(\text{Input Power})/(\text{Output Power})].$$

When the electromagnetic signals travel through the low-pass filter 10, a part of the input power is returned to a source of the electromagnetic signal. The part of the input power returned to the source of the electromagnetic signal is referred to as return power. The curve S11 represents the return loss indicating a relationship between the input power and the return power of the electromagnetic signal traveling through the low-pass filter 10, and the return loss is represented by the formula:

$$\text{Return Loss}=-10*\text{Log}\,[(\text{Input Power})/(\text{Return Power})]$$

For a filter, when the output power of the electromagnetic signal in a pass band frequency range is close to the input power of the electromagnetic signal, and the return power of the electromagnetic signal is small, it means that a distortion of the electromagnetic signal is small and the performance of the low-pass filter is good. That is, as the absolute value of the insertion loss of the electromagnetic signal is reduced, the absolute value of the return loss of the electromagnetic signal increases, as does performance of the filter.

As indicated by the curve S21 of FIG. 2, the absolute value of the insertion loss of the electromagnetic signal in the pass band frequency range is close to 0. As indicated by the curve S11, the absolute value of the return loss of the electromagnetic signal in the pass band frequency range exceeds 10, and the absolute value of the return loss of the electromagnetic signal beyond the pass band frequency range is less than 10. Therefore, the low-pass filter 10 has good performance.

Figure 5:
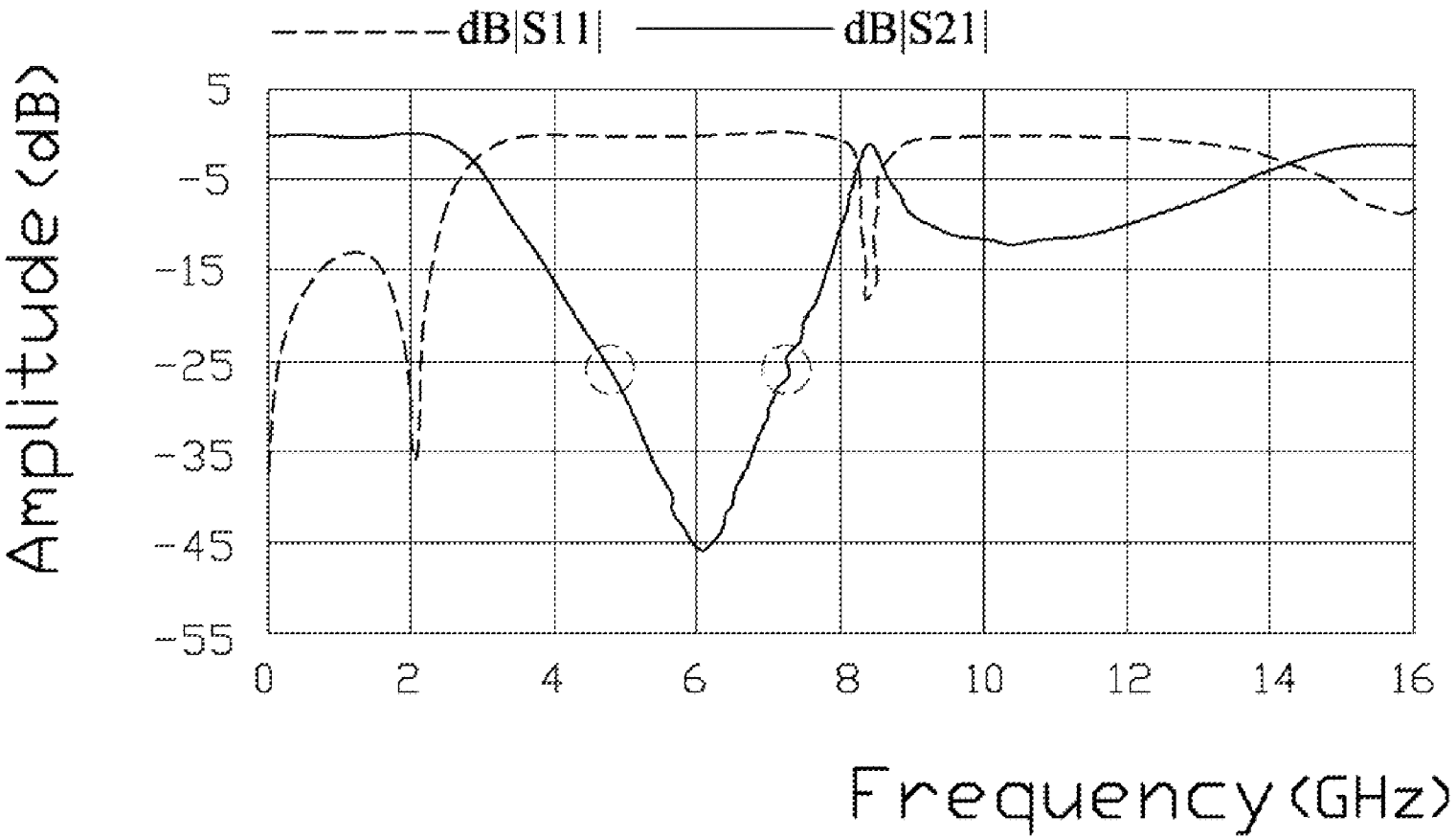
FIG. 5 (RELATED ART)
FIG. 5 is a diagram showing a relationship between amplitude insertion or return loss and frequency of electromagnetic signals through the low-pass filter of FIG. 4.

As shown in FIG. 3, two transmission zero points are generated, so that the low-pass filter 10 can effectively suppress harmonic noise. In addition, comparing FIG. 3 with FIG. 5, an attenuation rate of the filter 10 exceeds an attenuation rate of the conventional filter 40. Therefore, filtering by the low-pass filter 10 is improved.

While embodiments of the present invention have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A low-pass filter comprising:

an input portion inputting an electromagnetic signal;

an output portion outputting the electromagnetic signal;

a high impedance transmission portion electrically connected to the input portion and the output portion to transmit the electromagnetic signal therebetween;

a first low impedance transmission portion electrically connected to the input portion and one end of the high impedance transmission portion; and a second low impedance transmission portion electrically connected to the output portion and another end of the high impedance transmission portion;

wherein the second low impedance transmission portion is disposed between the high impedance transmission portion and the first low impedance transmission portion, and the second low impedance transmission portion and the high impedance transmission portion cooperatively define an E-shaped space therebetween.

2. The low-pass filter as recited in claim 1, wherein each of the first and second low impedance transmission portions is right triangular.

3. The low-pass filter as recited in claim 2, wherein a hypotenuse of the first low impedance transmission portion is coupled to a hypotenuse of the second low impedance transmission portion.

4. The low-pass filter as recited in claim 2, wherein an end portion of the hypotenuse of the first low impedance transmission portion is electrically connected to the input portion and the high impedance transmission portion, and a vertically angled portion of the second low impedance transmission portion is electrically connected to the output portion and the high impedance transmission portion.

5. The low-pass filter as recited in claim 4, wherein another end portion of the hypotenuse of the first low impedance transmission portion is free, as are two end portions of the hypotenuse of the second low impedance transmission portion.

6. The low-pass filter as recited in claim 1, wherein a slot is formed between the first low impedance transmission portion and the second low impedance transmission portion.

7. The low-pass filter as recited in claim 1, wherein the high impedance transmission portion extends varyingly from the input portion to the output portion.

8. The low-pass filter as recited in claim 1, wherein the high impedance transmission portion comprises a bent portion having an angular concertinaed configuration.

* * * * *